US006701687B1

(12) United States Patent
Shillingburg

(10) Patent No.: US 6,701,687 B1
(45) Date of Patent: Mar. 9, 2004

(54) MODULAR WALL BLOCK WITH MECHANICAL COURSE CONNECTOR

(75) Inventor: Curtis W. Shillingburg, Rock Hill, SC (US)

(73) Assignee: Ridgerock Retaining Walls Inc., Charlotte, NC (US)

( * ) Notice: Subject to any disclaimer, the term of this patent is extended or adjusted under 35 U.S.C. 154(b) by 0 days.

(21) Appl. No.: 10/432,000

(22) Filed: May 8, 2003

(51) Int. Cl.[7] ..... E04B 5/04

(52) U.S. Cl. ..... 52/606; 52/600; 52/284; 405/284

(58) Field of Search ..... 52/596, 600, 603, 52/604, 605, 284, 285.1, 285.4; 405/284, 286, 287

(56) References Cited

U.S. PATENT DOCUMENTS 4,920,712 A 5/1990 Dean, Jr.
5,540,525 A * 7/1996 Miller et al. ..... 405/284
5,586,841 A * 12/1996 Anderson et al. ..... 405/286
5,595,460 A * 1/1997 Miller et al. ..... 405/284
5,624,211 A * 4/1997 Anderson et al. ..... 405/286
6,019,550 A * 2/2000 Wrigley et al. ..... 405/262
6,168,354 B1 * 1/2001 Martin et al. ..... 405/284
6,189,282 B1 * 2/2001 VanderWerf ..... 52/582.1
6,295,772 B1 * 10/2001 Whitson ..... 52/182
6,318,934 B1 * 11/2001 Borgersen et al. ..... 405/262
6,338,597 B1 * 1/2002 Rainey ..... 405/262
6,474,036 B2 * 11/2002 Martin et al. ..... 52/604
6,622,445 B1 * 9/2003 Shillingburg et al. ..... 52/606

* cited by examiner

*Primary Examiner*—Leslie A. Braun
*Assistant Examiner*—Steven Marsh
(74) *Attorney, Agent, or Firm*—Schwartz Law Firm, P.C.

(57) ABSTRACT

A modular wall block is adapted for being assembled together with a number of other blocks in stacked courses to form a retaining wall. The wall block has a front and rear, top and bottom, and opposing sides. At least one of the opposing sides defines a generally L-shaped vertical slot. A course connector is received in the vertical slot, and includes first and second ends joined together by a setback spacer. The first end extends in an x-direction and a y-direction, and defines a generally L-shaped structure received in the L-shaped slot and restricting forward, rearward, and outward movement of the course connector. The second end of the course connector extends outwardly in a z-direction beyond one of the top and bottom of the wall block to engage one of the number of other blocks in an upper or lower course. The setback spacer locates the second end of the course connector a spaced distance from the first end to position the wall block in the retaining wall relative to the other blocks in the upper or lower course.

20 Claims, 11 Drawing Sheets

MODULAR WALL BLOCK WITH MECHANICAL COURSE CONNECTOR

TECHNICAL FIELD AND BACKGROUND OF INVENTION

This invention relates to a modular wall block including one or more mechanical course connectors, and a retaining wall constructed of an assembly of such blocks in stacked courses. The invention is particularly applicable for landscaping around residential and commercial structures to retain and preserve the surrounding soil while promoting the aesthetics of the area. As a result of its relatively low cost, ease of manufacture, and handling, concrete masonry block has emerged as one of the most popular and widely accepted material for use in constructing retaining walls. Blocks of this type are molded in a form.

Conventional retaining walls formed of concrete blocks are constructed in stacked courses with the ascending courses typically setback to counter the pressure of the soil acting against the wall. Mechanical means, such as geogrid mats or tie-backs, are commonly used to help stabilize the soil and further anchor the blocks in the wall. While such means are generally effective, a need exists in the industry for an improved course connector which mechanically interconnects the stacked block courses without interfering with placement or setback requirements, and which promotes stable, efficient, and precise construction of the retaining wall.

SUMMARY OF INVENTION

Therefore, it is an object of the invention to provide an improved wall block which uses course connectors to readily and conveniently position, align, and secure the blocks in stacked courses of the retaining wall.

It is another object of the invention to provide an improved wall block which uses a mechanical course connector to establish the setback of the block relative to an upper or lower course of blocks.

It is another object of the invention to provide an improved wall block which uses a mechanical course connector to achieve uniform and consistent setback throughout curves in the retaining wall.

It is another object of the invention to provide an improved wall block which is relatively lightweight and easy to handle.

It is another object of the invention to provide an improved wall block which is especially applicable for landscaping around plants and shrubs.

It is another object of the invention to provide an improved wall block with a rear portion adapted for being conveniently broken off and sides of reduced dimension, such that only a small portion of the block top is visible after backfilling with soil.

It is another object of the invention to provide an improved wall block which maximizes the available space surrounding the block for plantings.

It is another object of the invention to provide an improved course connector for use in combination with a wall block to position, secure, and align the block in a stacked course of the retaining wall.

It is another object of the invention to provide an improved course connector which extends in three mutually perpendicular directions.

It is another object of the invention to provide an improved course connector which is integrally molded of a relatively inexpensive material.

It is another object of the invention to provide an improved course connector which is formed in a variety of sizes to conveniently and accurately define the setback of the upper course block relative to the lower course blocks.

It is another object of the invention to provide an improved course connector which readily penetrates geogrid matting, and serves to further secure the matting between adjacent courses of the retaining wall.

It is another object of the invention to provide a retaining wall constructed of a number of like wall blocks.

These and other objects of the present invention are achieved in the preferred embodiments disclosed below by providing a modular wall block adapted for being assembled together with a number of other blocks in stacked courses to form a retaining wall. The wall block has a front and rear, top and bottom, and opposing sides. At least one of the opposing sides defines a generally L-shaped vertical slot. A course connector is received in the vertical slot, and includes first and second ends joined together by a setback spacer. The first end extends in an x-direction and a y-direction, and defines a generally L-shaped structure received in the L-shaped slot of the wall block. When positioned in the wall block, movement of the course connector is restricted in all directions except upwardly towards the top of the block and downwardly towards the bottom. The second end of the course connector extends outwardly in a z-direction beyond one of the top and bottom of the wall block to engage one of the number of other blocks in an upper or lower course. The setback spacer locates the second end of the course connector a spaced distance from the first end to position the wall block in the retaining wall relative to the other blocks in the upper or lower course.

The terms "x, y, and z-directions" are used broadly herein to mean directions along respective axes which run parallel to Cartesian x, y, and z-axes, and which do not all pass through a single common point but which are mutually perpendicular in three dimensions.

According to another preferred embodiment, the setback spacer extends in a direction generally parallel to a portion of the first end of the course connector.

According to another preferred embodiment, the second end of the course connector forms an elongated vertical spike extending in the z-direction generally perpendicular to the setback spacer.

According to another preferred embodiment, the vertical spike and setback spacer of the course connector are integrally formed together at a center portion of the vertical spike, such that course connector is applicable for use on either of the opposing sides of the wall block.

According to another preferred embodiment, the vertical spike of the course connector defines opposing pointed ends adapted to facilitate penetration of the vertical spike through earthen backfill located behind the retaining wall.

According to another preferred embodiment, the course connector is integrally-formed of a molded material.

According to another preferred embodiment, the course connector is formed of a glass-filled nylon.

According to another preferred embodiment, the top of the wall block defines a lateral tie-back channel extending from one side of the block to the other. The channel is adapted for receiving an elongated tie-back element cooperating to anchor the block to earthen backfill behind the retaining wall.

According to another preferred embodiment, an edge defining the lateral channel is beveled to facilitate placement of the tie-back element in the wall block.

According to another preferred embodiment, an edge defining the vertical slot is rounded adjacent the top of the wall block for accommodating an anchor strap positioned in the lateral tie-back channel and extending rearwardly into earthen backfill behind the retaining wall.

According to another preferred embodiment, the front, rear, and opposing sides define a hollow core of the wall block.

According to another preferred embodiment, the sides of the wall block taper inwardly from the front to the rear.

According to another preferred embodiment, the opposing sides of the wall block are reduced relative to the front and rear to allow an increased amount of soil behind the front.

In another embodiment, the invention is a retaining wall constructed of a number of modular wall blocks assembled in stacked courses. Each of the wall blocks has a front and rear, top and bottom, and opposing sides. At least one of the opposing sides defines a generally L-shaped vertical slot. A course connector is received in the vertical slot, and includes first and second ends joined together by a setback spacer. The first end extends in an x and y-direction, and defines a generally L-shaped structure received in the L-shaped slot. When positioned in the wall block, movement of the course connector is restricted in all directions except upwardly towards the top of the block and downwardly towards the bottom. The second end of the course connector extends outwardly in a z-direction beyond one of the top and bottom of the wall block to engage one of the number of other blocks in an upper or lower course. The setback spacer locates the second end of the course connector a spaced distance from the first end to position the wall block in the retaining wall relative to the other blocks in the upper or lower course.

BRIEF DESCRIPTION OF THE DRAWINGS

Some of the objects of the invention have been set forth above. Other objects and advantages of the invention will appear as the description proceeds when taken in conjunction with the-following drawings, in which.

DESCRIPTION OF THE PREFERRED EMBODIMENT AND BEST MODE

Figure 1:
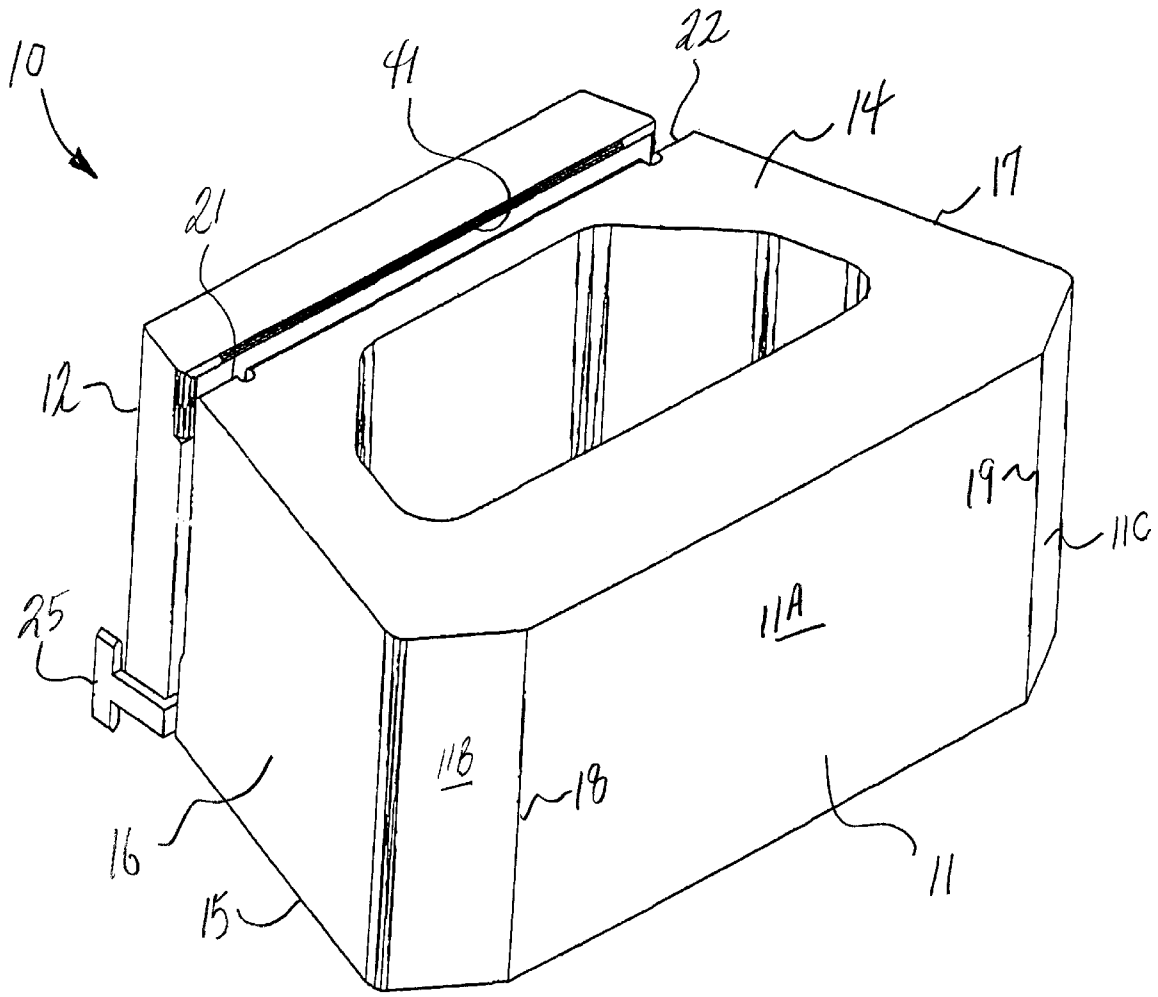
FIG. 1 is a front perspective view of a wall block according to one preferred embodiment of the present invention, and showing a course connector located in the vertical slot of the block.
Figure 2:
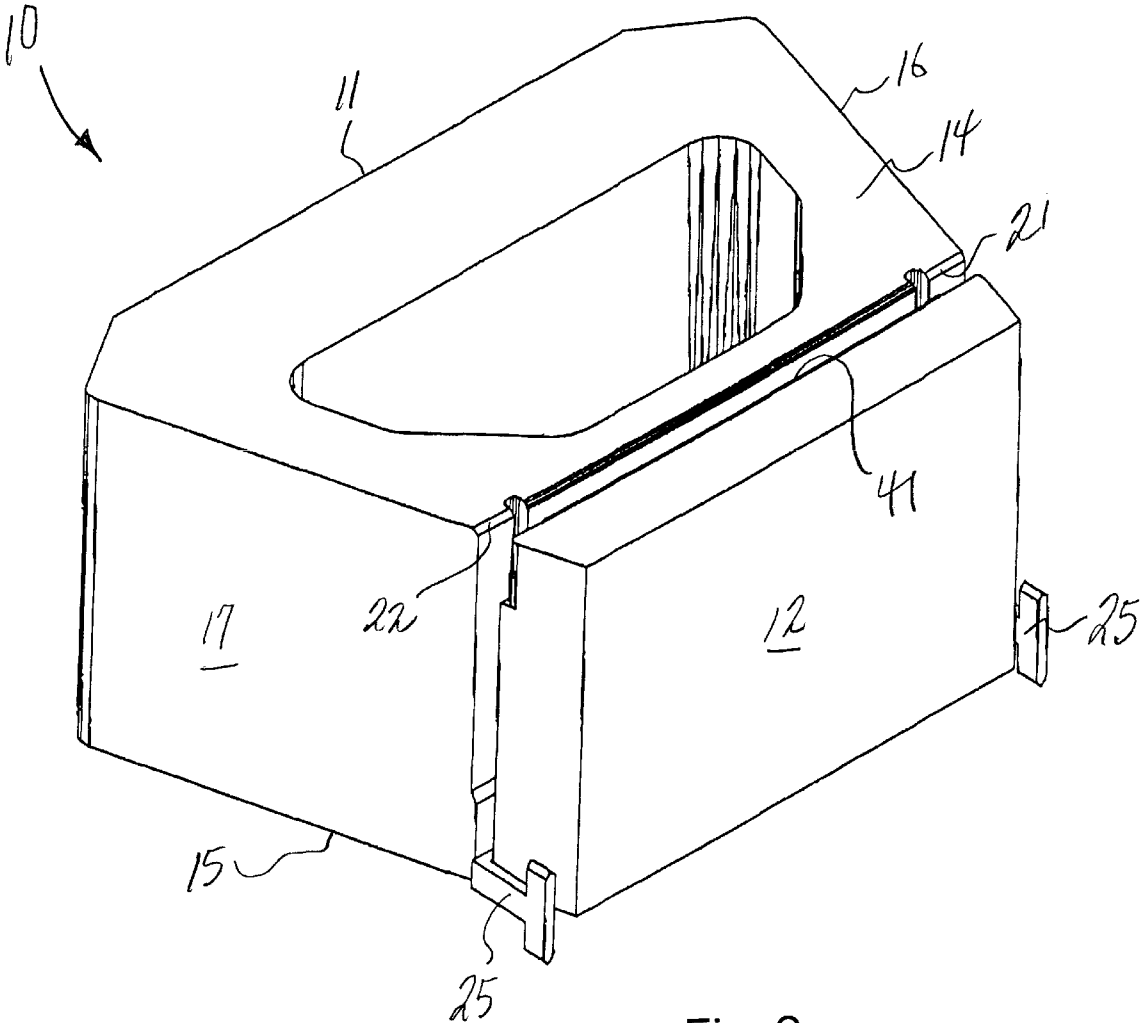
FIG. 2 is a rear perspective view of the wall block showing both course connectors located in respective vertical slots.
Figure 3:
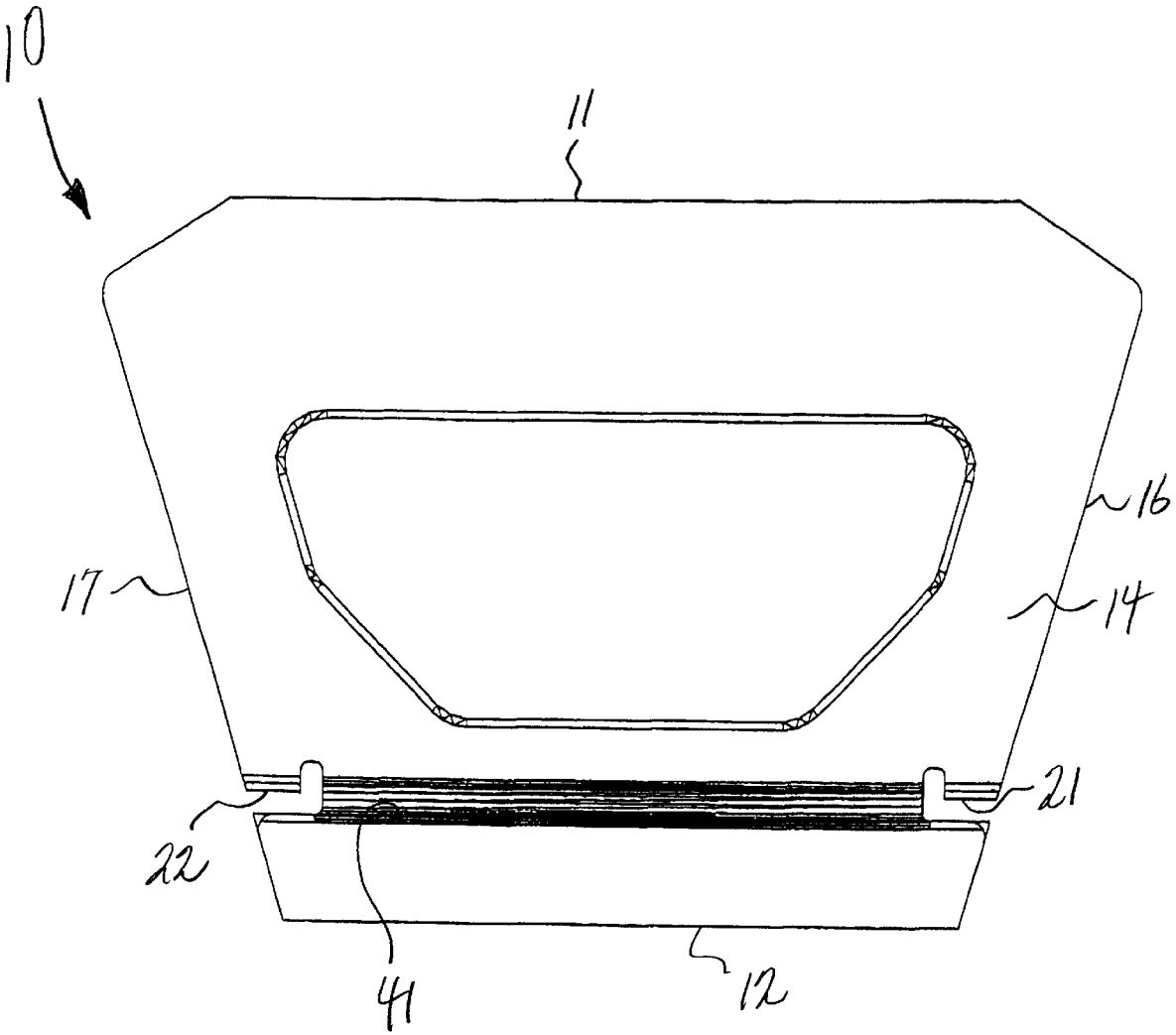
FIG. 3 is a top plan view of the wall block with the course connectors removed.
Figure 4:
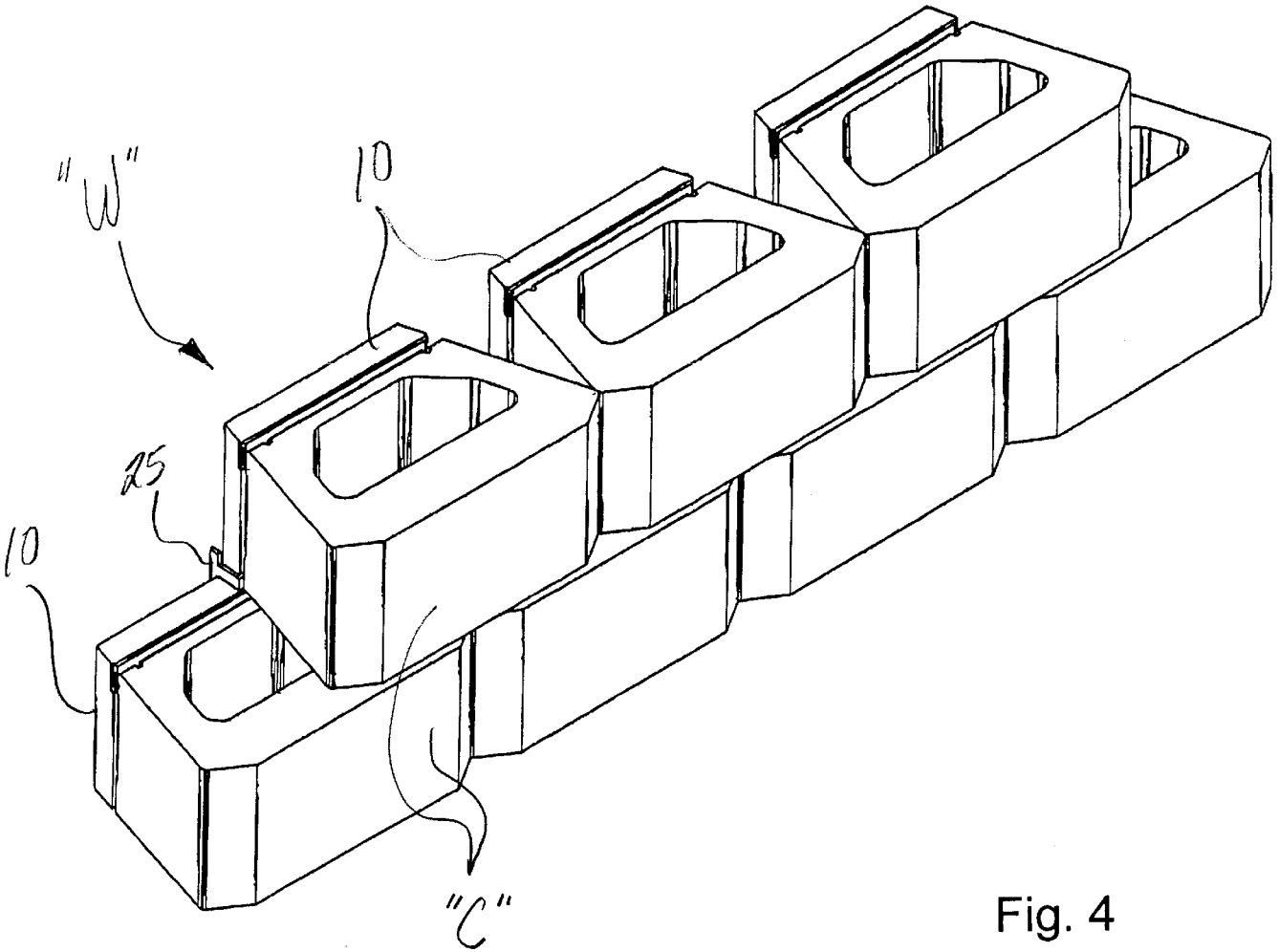
FIG. 4 is a front perspective view of a partially completed retaining wall formed using wall blocks of the present invention.
Figure 5:
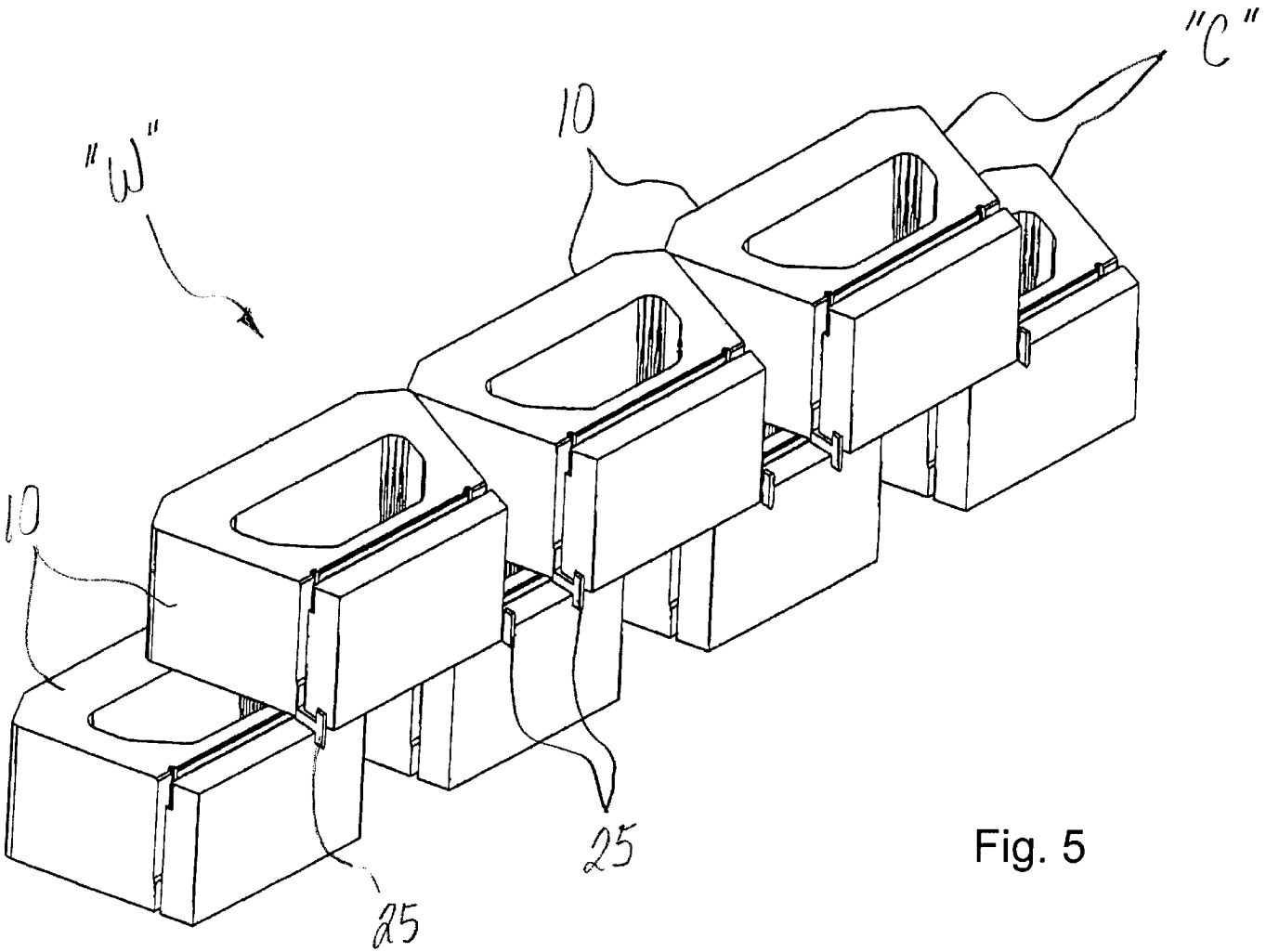
FIG. 5 is a rear perspective view of the retaining wall.

Referring now specifically to the drawings, a modular wall block according to the present invention is illustrated in FIGS. 1–3, and shown generally at reference numeral 10. The wall block 10 is adapted for being assembled, as shown in FIGS. 4 and 5, with a number of like blocks in stacked courses "C" to form a retaining wall "W". The wall blocks 10 are preferably formed of molded masonry concrete.

The wall block 10 has a front 11 and rear 12, top 14 and bottom 15, and opposing sides 16 and 17. In one embodiment, the front 11 includes vertical breaks 18 and 19 defining a center face portion 11A and opposing side face portions 11B and 11C. Preferably, the center face portion 11A has an aesthetic, unfinished, rough textured surface. The core of the wall block 10 is hollow to reduce the overall weight of the block 10, and for convenient handling and placement of the block 10 during construction of the retaining wall.

The sides 16 and 17 define respective vertical, L-shaped slots 21 and 22 extending through the wall block 10 from the top 14 to the bottom 15. The vertical slots 21, 22 are designed to receive mechanical course connectors 25, described below, which operate to conveniently position, align, and secure the wall blocks 10 in the retaining wall "W", as shown in FIGS. 4 and 5. Alternatively, the vertical slots 21, 22 may extend only partially through the wall block 10.

Figure 6:
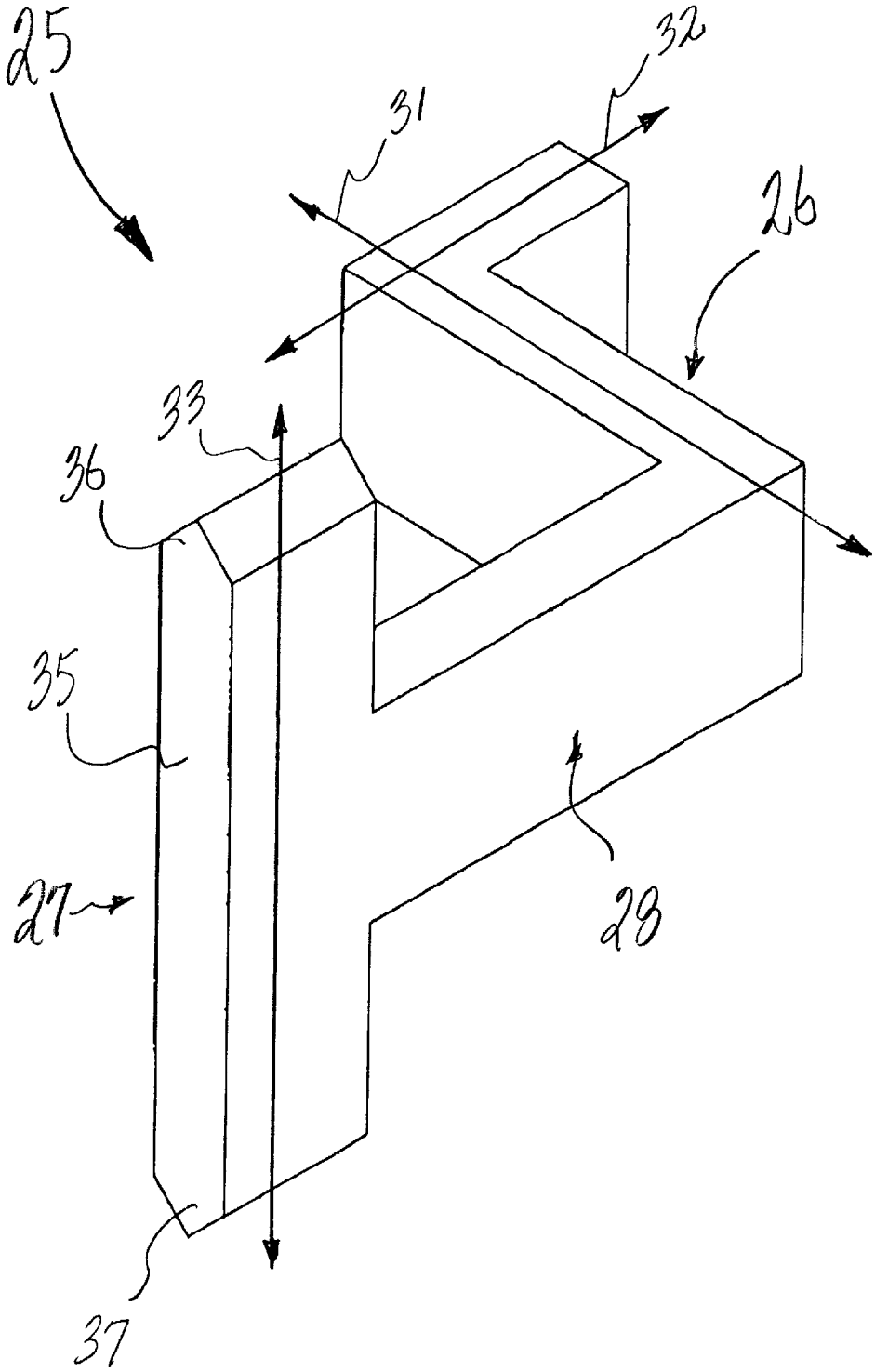
FIG. 6 is an enlarged, first perspective view of the course connector.
Figure 7:
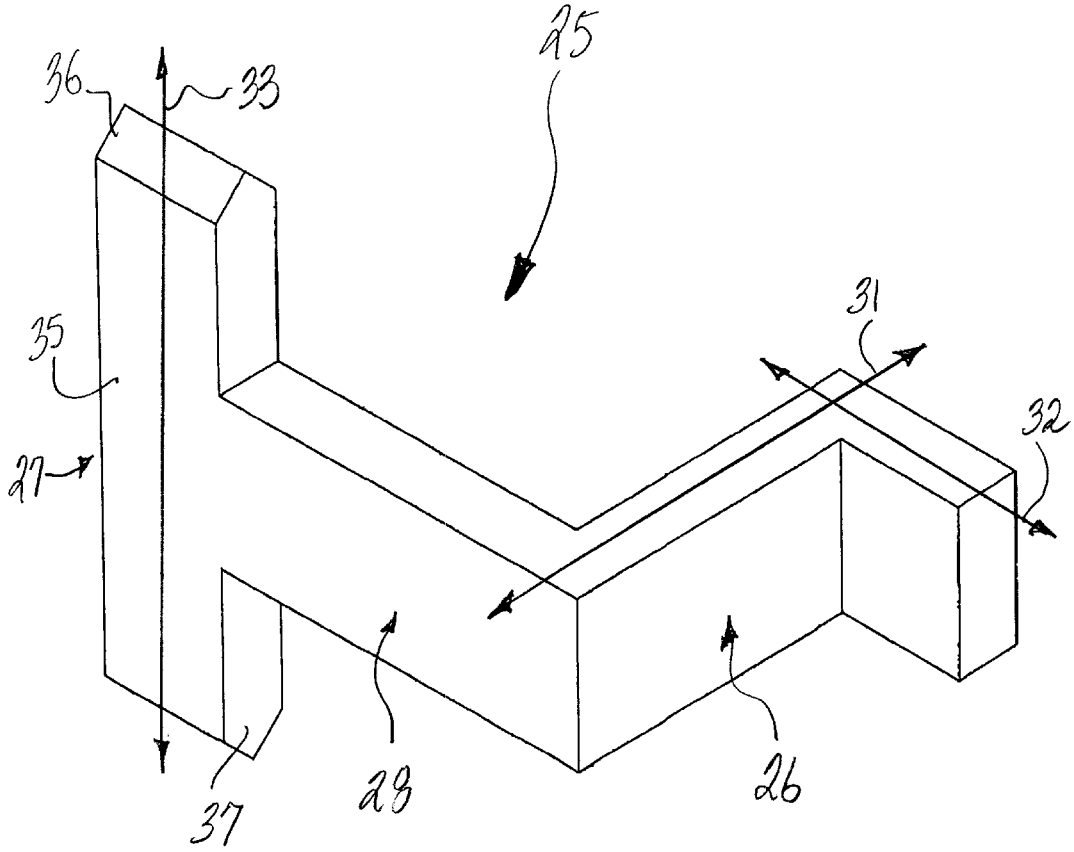
FIG. 7 is an enlarged, second perspective view of the course connector.
Figure 8:
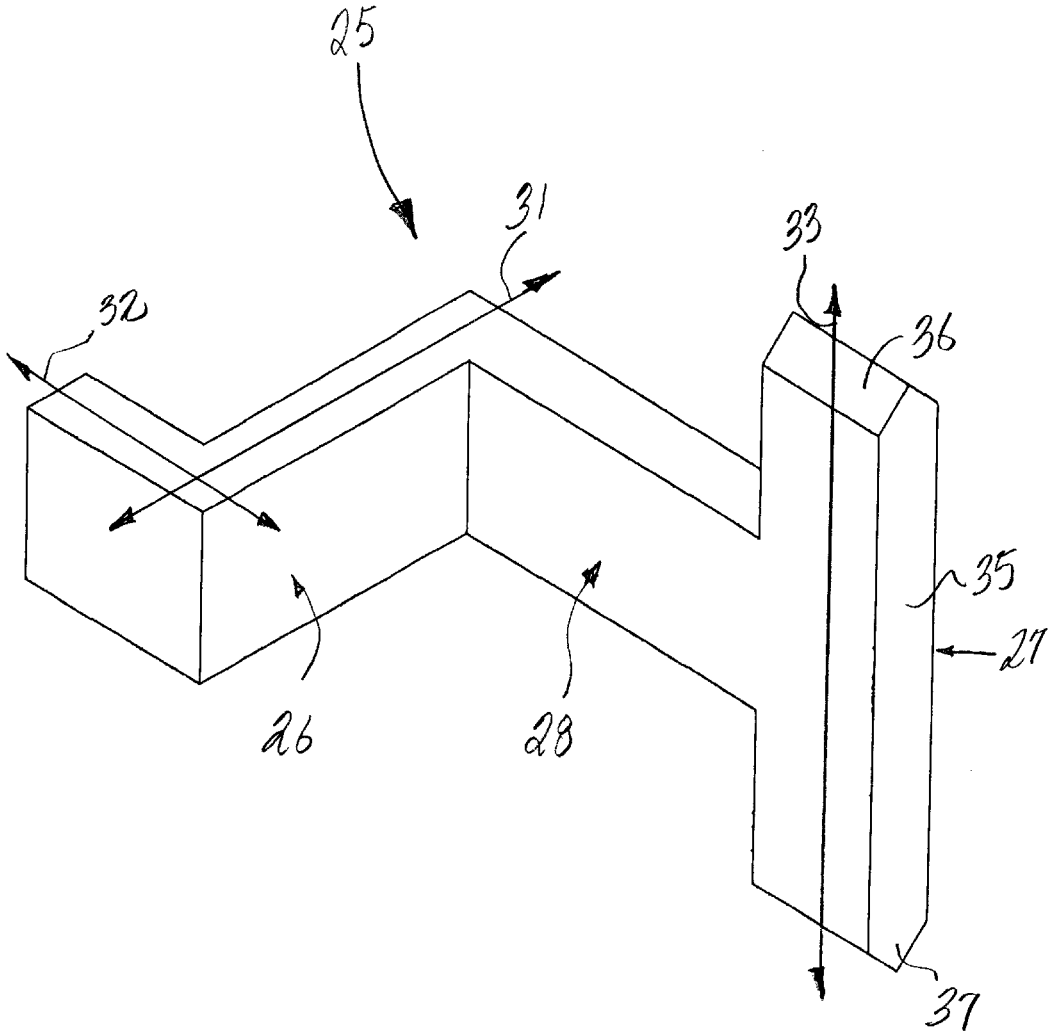
FIG. 8 is an enlarged, third perspective view of the course connector.
Figure 9:
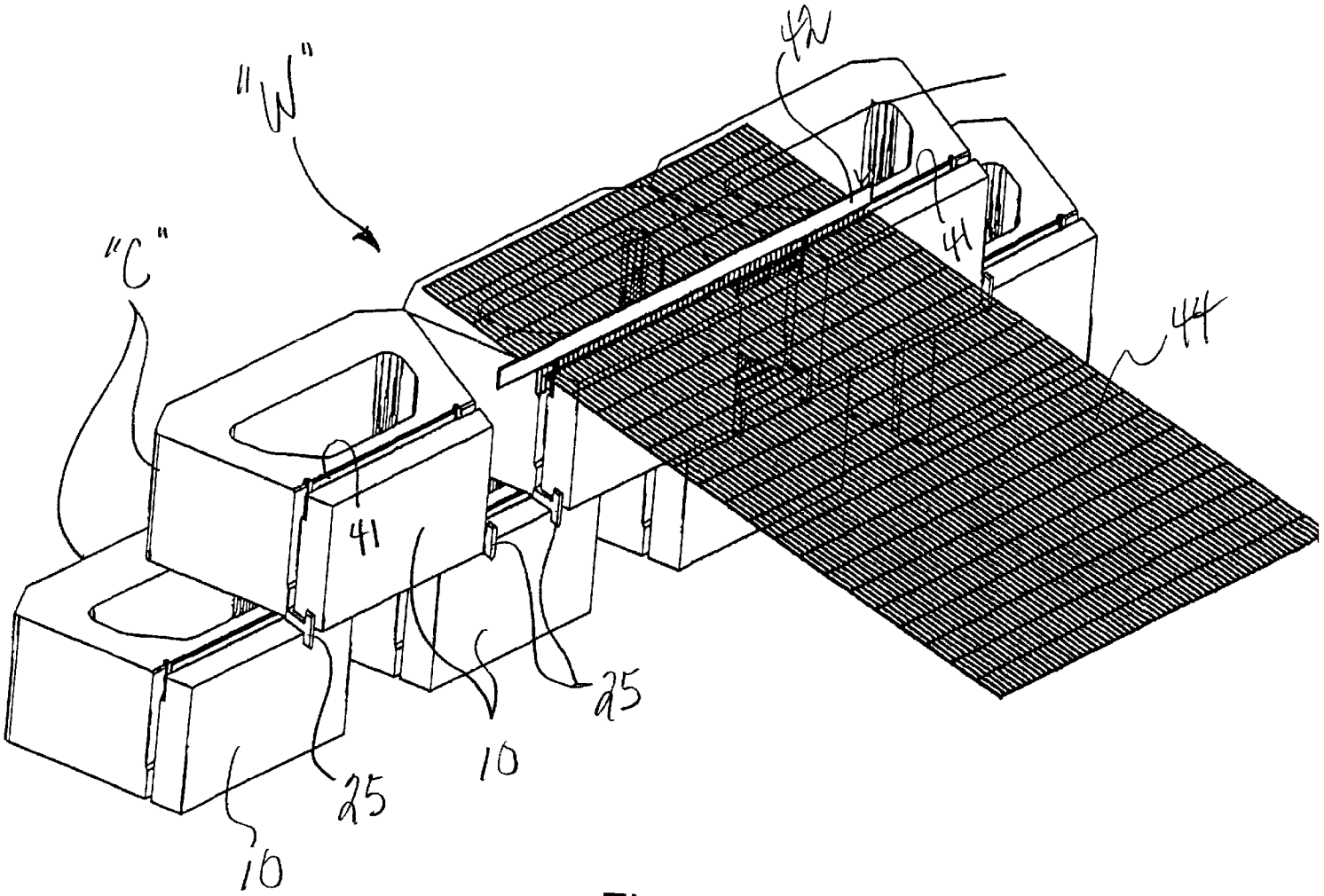
FIG. 9 is a rear perspective view of a partially completed retaining wall with geogrid matting arranged for placement between adjacent courses of the wall.

A single course connector 25 is illustrated in FIGS. 6, 7, and 8. The course connector 25 is preferably molded of a glass-filled nylon, and includes first and second ends 26 and 27 integrally joined together by a setback spacer 28. The first end 26 extends in both an x-direction and y-direction, as indicated at 31 and 32, respectively, and defines a generally L-shaped structure which is received in the corresponding vertical slot 21, 22 of the wall block 10. When properly positioned in the vertical slot 21, 22, movement of the course connector 25 is restricted in all directions except upwardly towards the top 14 of the block 10 and downwardly towards the bottom 15. The elongated setback spacer 28 is integrally formed with the first end 26 of the course connector 25, and extends in a direction perpendicular to the x-direction 31 of the first end 26 and parallel to the y-direction 32 of the first end 26.

The opposite end of the setback spacer 28 is integrally formed with the second end 27 of the course connector 25. The second end 27 extends perpendicular to the setback spacer 28 in a z-direction indicated at 33. The second end 27 comprises a vertical spike 35 with opposing pointed ends 36 and 37. When the blocks 10 are assembled in the retaining wall "W", as shown in FIGS. 4 and 5, one of the spike ends 36, 37 projects outwardly beyond the bottom 15 of the wall block 10 to engage one of the other stacked blocks 10 in a lower course. Preferably, the setback spacer 28 is joined at a center portion of the vertical spike 35 to form opposing identical spike ends, such that the course connector 25 is applicable for use in either the right or left side slot 21, 22 of the wall block 10. The pointed spike ends 36 and 37 facilitate penetration of the course connector 25 through soil backfill behind the retaining wall "W", and through tie-back elements such as polyester geogrid matting sandwiched between courses "C". The setback spacer 28 locates the vertical spike 35 a spaced distance from the first end 26 of the course connector 25 to position the wall block 10 in the retaining wall "W" relative to the other blocks 10 in the upper and lower course "C". The degree of setback is controlled by the length of the spacer 28. For example, a relatively short setback spacer 28 will result in greater setback from one stacked course to the next. A longer setback spacer 28 will result in less setback.

In alternative embodiments (not shown), the course connector may have a first end which extends in only a single x or y-direction, as previously defined, or which is hooked to hold the course connector in the wall block. The second end of the course connector may include only a single free end which may or may not be pointed. In addition, the first and second ends may extend at respective obtuse or acute angles relative to the setback spacer.

Referring to FIGS. 1–3 and 9, the top 14 of the wall block 10 defines a lateral tie-back channel 41 extending from one side of said block 10 to the other. The channel 41 is designed to receive a tie-back element, such as a flat elongated tie-back bar 42 shown in FIG. 9. The tie-back bar 42 may span several wall blocks 10, and resides inside the channel 41 between geogrid matting 44 and blocks 10 in an upper course "C". The geogrid matting 44 anchors the blocks 10 to soil backfill behind the retaining wall "W". Preferably, the edges defining the tie-back channel 41 are beveled to accommodate insertion of the tie-back bar 42 and geogrid matting 44. In an alternative application, the tie-back element may be a elongated flexible tie-back strap (not shown) which extends through the channel 41 and rearwardly into the soil backfill. The back edge of each pair of edges defining respective vertical slots 21, 22 in the wall block 10 is preferably rounded to accommodate proper placement and use of the strap. After assembling the blocks 10, as described above, a course of molded concrete wall caps (not shown) is preferably laid over the top course to finish the retaining wall.

Figure 10:
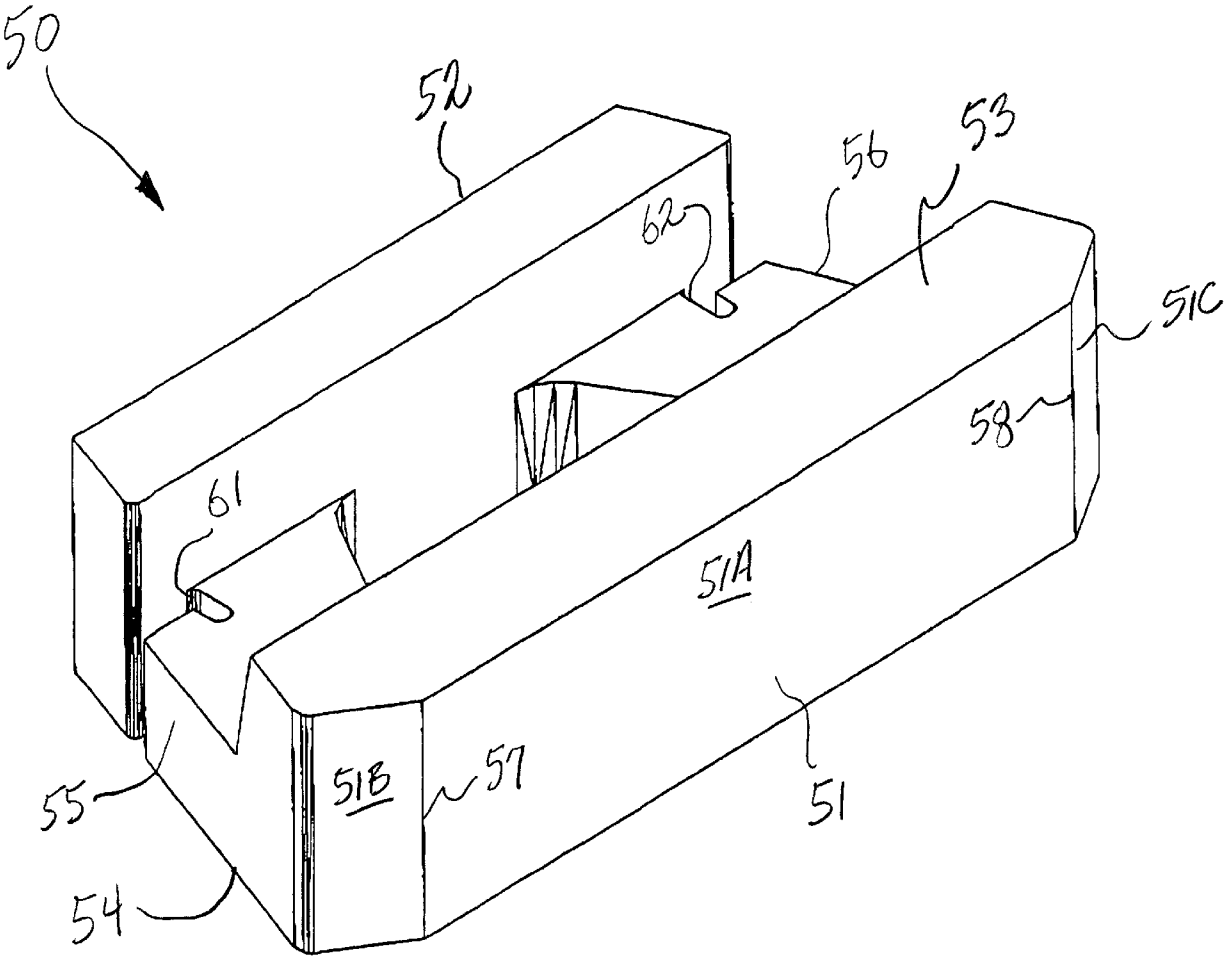
FIG. 10 is a front perspective view of a wall block according to a second preferred embodiment of the present invention.
Figure 11:
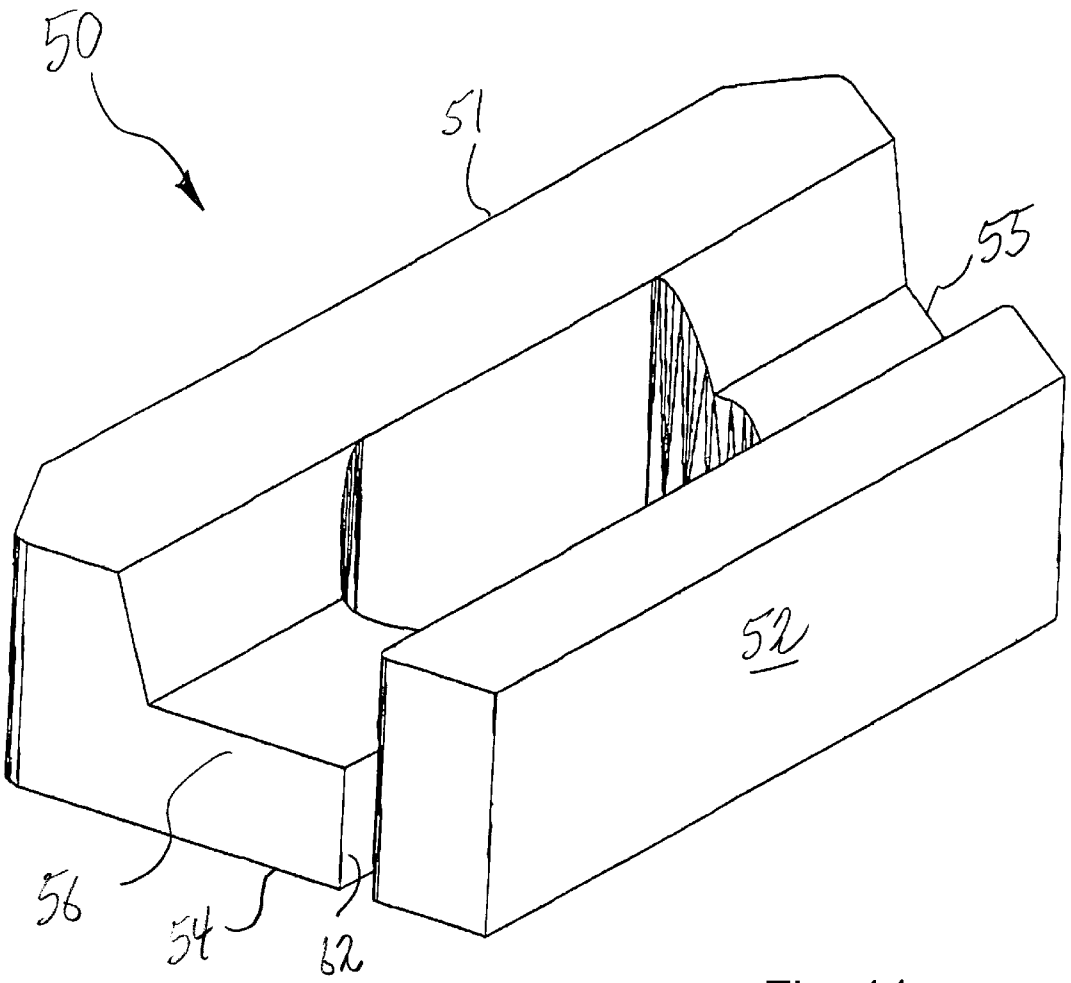
FIG. 11 is a rear perspective view of the wall block shown in FIG. 10.

A further embodiment of a wall block 50 according to the present invention is shown in FIGS. 10 and 11. The smaller block 50 is especially applicable in commercial and residential landscaping. Like wall block 10, block 50 has a front 51 and rear 52, top 53 and bottom 54, and opposing sides 55 and 56. The front 51 includes vertical breaks 57 and 58 defining a center face portion 51A and opposing side face portions 51B and 51C. The core of the wall block 50 is hollow and the sides 55 and 56 are reduced relative to the front 51 and rear 52 to substantially reduce the overall weight of the block 50. The sides 55, 56 define respective vertical, L-shaped slots 61 and 62 extending through the wall block 50 from the top 53 to the bottom 54. The vertical slots 61, 62 receive mechanical course connectors, identical to the connector 25 described above, which operate to conveniently position, align, and secure the blocks 50 in a landscape wall. To further reduce weight and promote handling, the rear 52 of the block 50 may be broken off using a hammer or other suitable tool. The reduced sides 55, 56 allow increased placement of soil directly behind the front 51 of the block 50 to conceal a substantial portion of the top 53, and to maximize the available surrounding space for plantings.

A wall block is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A modular wall block adapted for being assembled together with a number of other blocks in stacked courses to form a retaining wall, said wall block comprising:

(a) a front and rear, top and bottom, and opposing sides, at least one of the opposing sides defining a generally L-shaped vertical slot; and (b) a course connector received in the vertical slot and comprising first and second ends joined together by a setback spacer, the first end extending in an x-direction and a y-direction and defining a generally L-shaped structure received in the L-shaped vertical slot to hold said course connector in said wall block, and the second end of said course connector extending outwardly in a z-direction beyond one of the top and bottom of said wall block to engage one of the number of other blocks in an upper or lower course, and said setback spacer locating the second end of said course connector a spaced distance from the first end to position said wall block in the retaining wall relative to the other blocks in the upper or lower course.

2. A modular wall block according to claim 1, wherein the setback spacer extends in a direction generally parallel to a portion of the first end of said course connector.

3. A modular wall block according to claim 1, wherein the second end of said course connector comprises an elongated vertical spike extending in the z-direction generally perpendicular to the setback spacer.

4. A modular wall block according to claim 3, wherein the vertical spike and setback spacer of said course connector are integrally formed together at a center portion of the vertical spike, such that said course connector is applicable for use on either of the opposing sides of said wall block.

5. A modular wall block according to claim 4, wherein the vertical spike of said course connector defines opposing pointed ends adapted to facilitate penetration of the vertical spike through earthen backfill located behind the retaining wall.

6. A modular wall block according to claim 1, wherein said course connector is integrally-formed of a molded material.

7. A modular wall block according to claim 6, wherein said course connector comprises a glass-filled nylon.

8. A modular wall block according to claim 1, wherein the top of said wall block defines a lateral tie-back channel extending from one side of said block to the other, and adapted for receiving an elongated tie-back element cooperating to anchor said block to earthen backfill behind the retaining wall.

9. A modular wall block according to claim 8, wherein an edge defining the lateral channel is beveled to facilitate placement of the tie-back element in said wall block.

10. A modular wall block according to claim 9, wherein an edge defining the vertical slot is rounded adjacent the top of said wall block for accommodating an anchor strap positioned in the lateral tie-back channel and extending rearwardly into earthen backfill behind the retaining wall.

11. A wall block according to claim 1, the front, rear, and opposing sides define a hollow core of the wall block.

12. A wall block according to claim 1, wherein the opposing sides are reduced relative to the front and rear to allow an increased amount of soil behind the front.

13. A retaining wall constructed of a number of modular wall blocks assembled in stacked courses, each of said wall blocks comprising:

(a) a front and rear, top and bottom, and opposing sides, at least one of the opposing sides defining a generally L-shaped vertical slot; and (b) a course connector received in the vertical slot and comprising first and second ends joined together by a setback spacer, the first end extending in an x-direction and a y-direction and defining a generally L-shaped structure for being received in the L-shaped vertical slot to hold said course connector in said wall block, and the second end of said course connector extending outwardly in a z-direction beyond one of the top and bottom of said wall block to engage one of a number of other blocks in an upper or lower course, and said setback spacer locating the second end of said course connector a spaced distance from the first end to position said wall block in the retaining wall relative to the other blocks in the upper or lower course.

14. A retaining wall according to claim 13, wherein the setback spacer extends in a direction generally parallel to a portion of the first end of said course connector.

15. A retaining wall according to claim 13, wherein the second end of said course connector comprises an elongated vertical spike extending in the z-direction generally perpendicular to the setback spacer.

16. A retaining wall according to claim 15, wherein the vertical spike and setback spacer of said course connector are integrally formed together at a center portion of the vertical spike, such that said course connector is applicable for use on either of the opposing sides of said wall block.

17. A retaining wall according to claim 16, wherein the vertical spike of said course connector defines opposing pointed ends adapted to facilitate penetration of the vertical spike through earthen backfill located behind the retaining wall.

18. A retaining wall according to claim 13, wherein said course connector is integrally-formed of a glass-filled nylon.

19. A retaining wall according to claim 13, wherein the top of said wall block defines a lateral tie-back channel extending from one side of said block to the other, and adapted for receiving a tie-back element cooperating to anchor said block to earthen backfill behind the retaining wall.

20. A modular wall block according to claim 19, wherein an edge defining the lateral channel is beveled to facilitate placement of the tie-back element in said wall block.

* * * * *